US009472318B2

(12) United States Patent
Wakabayashi et al.

(10) Patent No.: US 9,472,318 B2
(45) Date of Patent: Oct. 18, 2016

(54) WIRE HARNESS

(71) Applicant: SUMITOMO WIRING SYSTEMS, LTD., Mie (JP)

(72) Inventors: Masataka Wakabayashi, Mie (JP); Minoru Fukuda, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/824,606

(22) Filed: Aug. 12, 2015

(65) Prior Publication Data

US 2016/0064118 A1 Mar. 3, 2016

(30) Foreign Application Priority Data

Sep. 2, 2014 (JP) ..... 2014-178331

(51) Int. Cl.

| | |
|---|---|
| ***H01B 7/00*** | (2006.01) |
| ***H01B 3/30*** | (2006.01) |
| *H01R 103/00* | (2006.01) |
| *H01R 9/05* | (2006.01) |
| *H01R 24/30* | (2011.01) |

(52) U.S. Cl.

CPC ..... *H01B 7/0018* (2013.01); *H01R 9/0527* (2013.01); *H01R 24/30* (2013.01); *H01R 2103/00* (2013.01)

(58) Field of Classification Search

CPC .... H01B 9/02; H01B 7/0045; H01B 7/0018; H01R 2103/00; H01R 9/0527; H01R 24/30

USPC ..... 174/72 A, 110 R, 113 R

See application file for complete search history.

(56) References Cited

U.S. PATENT DOCUMENTS

| | | | | |
|---|---|---|---|---|
| 5,432,300 | A * | 7/1995 | Fujisawa | H01R 13/6599 174/19 |
| 6,160,216 | A * | 12/2000 | McMahon | H01B 7/0045 174/102 R |
| 2004/0026101 | A1* | 2/2004 | Ochi | H01B 7/0861 174/36 |
| 2009/0126993 | A1* | 5/2009 | Nishimura | H01B 3/28 174/72 A |

FOREIGN PATENT DOCUMENTS

| | | |
|---|---|---|
| JP | 10-125138 | 5/1998 |
| JP | 2009-093934 | 4/2009 |
| JP | 2010-021026 | 1/2010 |

* cited by examiner

*Primary Examiner* — Sherman Ng

(74) *Attorney, Agent, or Firm* — Greenblum & Bernstein, P.L.C.

(57) ABSTRACT

Provided is a wire harness having a shielding structure that can achieve a required shielding effect while sufficiently meeting the requirements of weight reduction and cost reduction. The wire harness includes a wire group constituted by a plurality of wires and a retaining member that surrounds the wire group such that the wire group is retained in the form of a bundle, wherein the wire group is configured to include a first wire composed of a linear conductor that is located toward the center of the wire group, a tube-shaped wire sheathing that surrounds the first wire, and a second wire and a third wire that are composed of an opposing pair of split tube-shaped conductors that are insulated from each other with the first wire and the wire sheathing being interposed therebetween.

5 Claims, 7 Drawing Sheets

WIRE HARNESS

TECHNICAL FIELD

The present invention relates to a wire harness, and in particular relates to a wire harness having an electromagnetic shielding structure that is suitable when used in a transistor input/output circuit, or the like.

BACKGROUND ART

Conventionally, a wire shielding structure in which a wire group in the segment to be shielded is wrapped in a braided wire shielding material, a spiral winding shielding material, aluminum foil, or the like, and is surrounded from the outside by an outer member for sheathing is frequently used in the case of performing shielding (electromagnetic shielding, or the like) on a wire group in a wire harness in a predetermined wiring segment (e.g., see JP H10-125138A and JP 2009-93934A).

Also, there are known to be electrical wires in which a conducting layer and an insulating layer that surrounds the conducting layer are formed on the outer circumferential surface of an inner non-metallic linear member in the interest of obtaining a shield effect and current density when using an AC current (e.g., see JP 2010-21026A).

JP H10-125138A, JP 2009-93934A, and JP 2010-21026A are examples of related art.

However, in conventional wire harnesses in which the wire group is surrounded by a shielding material and an outer material for sheathing, the wire bundle at the wiring segment that is to be shielded is covered by overlaying a shielding material such as a braided wire shielding material or a spiral winding shielding material and an outer material for sheathing thereon, and therefore, in addition to the winding task being time-consuming, the wire harness is bulky, and it is not possible to sufficiently meet the requirements of weight reduction and cost reduction in the wire harness. Also, if the wiring segment to be shielded takes up a large range, these problems are exacerbated.

In particular, with a wire harness including wires used in a transistor input/output circuit, the above-described problems are further exacerbated since covering is performed by overlaying the shielding material and the outer material for sheathing after signal wires are formed into a twisted pair wire as a countermeasure against noise.

Also, even in the case of using a conventional wire with an insulating layer formed on the outside of a tube-shaped conducting layer in a wire harness, it has been difficult to effectively cause the conducting member of such a wire to contribute to the shielding of another wire. For this reason, with such a wire harness, it is apparent that it is not possible to sufficiently meet the requirements of weight reduction and cost reduction in the wire harness due to the task of wrapping the wire group in a shielding material for shielding another wire being time-consuming and the wire harness being bulky.

SUMMARY OF THE INVENTION

The present invention has been made to resolve the foregoing problems with the conventional techniques, and it is an object thereof to provide a wire harness having a shielding structure that can achieve the required shielding effect while sufficiently meeting the requirements of weight reduction and cost reduction.

In order to achieve the above-described object, the wire harness according to the present invention is a wire harness including a wire group constituted by a plurality of wires and a retaining member that surrounds the wire group such that the wire group is retained in the form of a bundle, wherein the wire group is configured to include a first wire composed of a linear conductor that is located toward the center of the wire group, a tube-shaped wire sheathing that surrounds the first wire, and second and third wires composed of an opposing pair of split tube-shaped conductors that are insulated from each other with the first wire and the wire sheathing being interposed therebetween.

With this configuration, in the present invention, the first to third wires can be insulated from each other and easily integrated by causing the second wire and the third wire to conform to the outer circumferential surface of the wire sheathing surrounding the first wire, and the first to third wires, which can be used as conductors for three channels, can be arranged with a smaller radial dimension. Moreover, since the second wire and the third wire are opposing split tube-shaped conductors with the first wire interposed therebetween, an electromagnetic shielding effect of some extent can be achieved without adding a shielding material to the first wire. As a result, it is possible to manufacture a wire harness that can exhibit the required shielding effect while sufficiently meeting the requirements of weight reduction and cost reduction.

With the wire harness according to the present invention, it is preferable that the wire sheathing is formed so as to be in close contact with the outer circumferential surface of the first wire, the second wire and the third wire are formed so as to be fixed to the outer circumferential surface of the wire sheathing, and the first wire, the second wire, and the third wire are insulated from each other and integrated in the form of one wire.

With this configuration, it is easier to handle the first to third wires, whereby workability is improved.

The wire harness of the present invention may furthermore include a connector having a first terminal that connects the first wire to, among three terminals of a transistor, one terminal corresponding to output, and second and third terminals that respectively connect the second wire and the third wire to a positive terminal voltage side and a negative terminal voltage side of a power supply with respect to a transistor.

With this configuration, it is possible to achieve the required shielding effect while meeting the requirements of weight reduction and cost reduction in a wire harness that includes wires used in a transistor input/output circuit.

With the wire harness according to the present invention, the retaining member is constituted by an outer insulating sheathing that surrounds the second wire and the third wire and insulates them from each other, and the first wire, the second wire, the third wire, the wire sheathing, and the outer insulating sheathing are integrated in the form of one wire.

With this configuration, conductors for three channels can be provided in substantially one wire, thereby reducing the number of wires, which makes it even easier to handle the first to third wires and is further advantageous for weight reduction and cost reduction.

According to the present invention, it is possible to provide a wire harness having a shield structure according to which it is possible to exhibit the required shielding effect while sufficiently meeting the requirements of weight reduction and cost reduction.

EMBODIMENTS OF THE INVENTION

Hereinafter, embodiments of the present invention will be described with reference to the drawings.

Embodiment

FIGS. 1A-6D show a wire harness W according to an embodiment of the present invention.

Note that the wire harness W in the present embodiment is a unit obtained by mounting a connector, terminals, and the like to a wire group 1 composed of multiple wires, and is configured to be able to connect an electrical device mounted in a vehicle to a power supply, a control device, or the like.

The wire group 1 of the wire harness W has flexibility, which allows it to be arranged on a predetermined arrangement path on a vehicle panel (not shown), and a shielded segment at which a shield for electromagnetic shielding or the like is required is set at a position on the arrangement path.

Figure 1A:
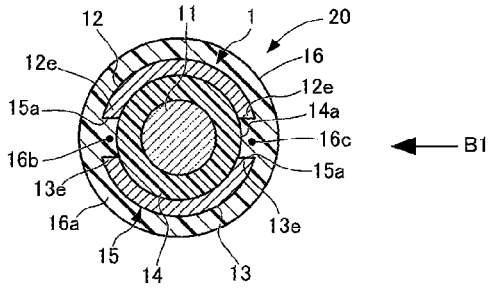
FIG. 1A is a cross-sectional view showing relevant portions of first to third wires that constitute a wire group in a wire harness according to an embodiment of the present invention.
Figure 1B:
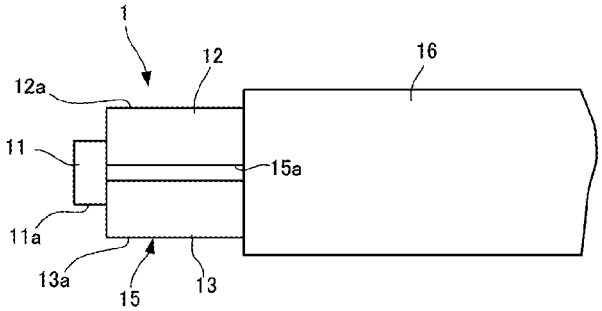
FIG. 1B is a view taken along arrow B1 in FIG. 1A.

As shown in FIGS. 1A and 1B, the wire harness W includes a wire group 1 including at least a first wire 11, a second wire 12, and a third wire 13, and includes a retaining member (to be described in detail later) that surrounds the wire group 1 such that the wire group is retained in the form of a bundle.

The first wire 11 is a linear member composed of a conductor that is approximately circular in cross-section and is located inside of the wire group 1, and a tube-shaped wire sheathing 14 is formed on an outer circumferential surface 11*a* of the first wire 11.

The first wire 11 is constituted by a circular stranded wire obtained by twisting together multiple flexible copper wires (flexible conducting wires), for example, but naturally, it may be constituted as a single-core wire instead of a stranded wire, or it may be constituted by a conductor in the form of a hollow wire.

The wire sheathing 14 is constituted by a cylindrical (tube-shaped) insulating material made of resin mainly composed of vinyl chloride, polyethylene, or the like, for example, and the outer circumferential surface 14*a* of the wire sheathing 14 is an approximately cylindrical surface. The wire sheathing 14 is formed by lamination such that it is in close contact with (fits closely to) the outer circumferential surface 11*a* of the first wire 11.

The second wire 12 and the third wire 13 are composed of an opposing pair of split tube-shaped conductors that are insulated from each other with the first wire 11 and the wire sheathing 14 being interposed therebetween, and an approximately cylindrical conducting layer 15 having a pair of slits 15*a* is formed by both the wires 12 and 13.

The second wire 12 and the third wire 13 are conductive films formed by one of aluminum (Al), iron (Fe), and copper (Cu), or by an alloy thereof, for example, and are formed so as to be fixed to the outer circumferential surface 14*a* of the wire sheathing 14.

Furthermore, the outer insulating sheathing 16 is formed by lamination on the outer circumferential surfaces 12*a* and 13*a* of the second wire 12 and the third wire 13.

The outer insulating sheathing 16 includes a tube-shaped sheathing portion 16*a* that surrounds and sheathes the second wire 12 and the third wire 13 from the outside and includes linear insulating portions 16*b* and 16*c* that insulate the second wire 12 and the third wire 13 from each other by being fixed to the outer circumferential surface 14*a* of the wire sheathing 14 between both opposing lateral edges 12*e* and 13*e* of the second wire 12 and the third wire 13.

The first wire 11, the second wire 12, the third wire 13, the wire sheathing 14, and the outer insulating sheathing 16 constitute a compound wire 20 in which the first to third wires 11 to 13 are insulated from each other by the wire sheathing 14 and the outer insulating sheathing 16 and are integrated in the form of one wire.

Figure 2:
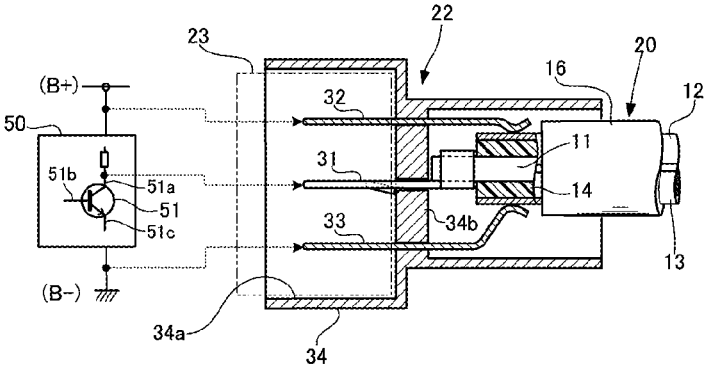
FIG. 2 is a cross-sectional side view showing relevant portions in a state in which a connector that can be connected to a transistor input/output circuit is mounted on the first to third wires of the wire harness shown in FIGS. 1A and 1B.

As shown in FIG. 2, the wire harness W is configured to include at least the compound wire 20 and a connector 22 mounted to the compound wire 20. Also, if the wire group 1 of the wire harness W is constituted by only the compound wire 20, the tube-shaped sheathing portion 16*a* of the outer insulating sheathing 16 constitutes a retaining member that retains the first wire 11, the second wire 12, and the third wire 13 in a bundle.

If the wire group 1 of the wire harness W includes the compound wire 20 and another wire, the compound wire 20 and the other wire are retained in a bundle by a retaining member such as a bundling band, bundling tape, or a corrugate tube instead of or in addition to the tube-shaped sheathing portion 16*a* of the outer insulating sheathing 16.

The connector 22 mounted to the compound wire 20 is constituted by a first terminal 31, a second terminal 32, and a third terminal 33, which correspond to the first wire 11, the second wire 12, and the third wire 13 respectively, and by a connector housing 34 that integrally retains the terminals 31 to 33.

As shown in FIGS. 2 to 5, the first to third terminals 31 to 33 are formed as male terminals, and the connector 22 is configured as a female connector.

A fitting recess 34*a* into which the female connector 23 indicated by the virtual lines in FIG. 2 can be fitted is formed in the connector housing 34.

Also, in the connector housing 34, the second and third terminals 32 and 33 are formed integrally in the inner bottom wall 34*b* of the fitting recess 34*a*, and the first terminal 31 fits into the terminal insertion hole 34*c* in the center of the inner bottom wall 34*b* such that it can be retained therein.

When the leading end of the female connector 23 is fit into the fitting recess 34*a* of the connector housing 34, the first to third terminals 31 to 33 are fit into and electrically connected to three female terminals (not illustrated in detail) that are supported on the connector housing of the female connector 23.

Also, the female connector 23 is connected to a transistor input/output circuit 50, which is part of a control path of a vehicle-mounted device, for example, and the first terminal 31 of the connector 22 connects the first wire 11 via the female connector 23 to, among three terminals 51*a*, 51*b*, and 51*c* (emitter, base, collector) of a transistor 51 in the transistor input/output circuit 50, one terminal 51*a* (emitter) corresponding to control output. On the other hand, the second terminal 32 and the third terminal 33 of the connector 22 respectively connect the second wire 12 and the third wire 13 to the positive terminal voltage (B+) side and the negative terminal voltage (B−) side of a power supply with respect to the transistor 51. The positive terminal voltage side and the negative terminal voltage side of a power supply with respect to the transistor 51 means that, in addition to the case of being connected to the positive terminal side and negative terminal side (ground side) of a power supply, the second wire 12 and the third wire 13 may be connected to a positive voltage line (+Va) and a negative voltage line (−Va) connected to the transistor input/output circuit 50 in the case where they exist. The transistor input/output circuit 50 is a circuit that is connected to the output terminal of a sensor, for example, and amplifies a detection signal thereof or generates an ON/OFF signal and transmits it to a vehicle-mounted ECU (electronic control unit) or the like.

With the wire group 1 of the wire harness W, the second wire 12 and the third wire 13, which roughly surround the first wire 11 with the wire sheathing 14 interposed therebetween, are connected to the positive terminal voltage (B+) side and the negative terminal voltage (B−) side of the power supply in this manner.

The second wire 12 and the third wire 13 are vapor-deposited films formed so as to be firmly fixed to the outer circumferential surface 14*a* of the wire sheathing 14 using high-frequency ion plating, which is a type of physical vapor deposition method.

For example, high-frequency ion plating in this context is executed using multiple vacuum chambers that are arranged in a direction of conveying a linear workpiece including the raw material for the wire sheathing 14, in a state in which the material for the vapor-deposited metal (hereinafter to be referred to as "vapor-deposited metal material") and the workpiece have been placed in a chamber of a later stage, which is equipped with an electron gun and a high-frequency induction coil.

Specifically, first, the vacuum chamber at an early stage is evacuated to a high vacuum of around $10^{-3}$ to $10^{-4}$ Pa, and the following chamber at a later stage is evacuated to an ultra-high vacuum of $10^{-8}$ Pa or more by a vacuum pump for an ultra-high vacuum (or an extreme high vacuum). Also, an inert gas or a reactive gas is inserted into the chamber at a later stage, at the same time as the evacuation.

Then, by passing a high-frequency current through the induction coil in the chamber at a later stage in the ultra-high vacuum state, low-temperature plasma that is separated into ions and electrons is generated inductively by the high-frequency electromagnetic field, and the metal is evaporated by negatively biasing the material for the sheathing wire, which is an insulating material, and bombarding the metal vapor deposition material with an electron beam.

At this time, the metal particles become positive ions and accelerate toward the workpiece, and when the reactive gas is inserted into the chamber, the reactive gas bonds with the metal particles, prompting a chemical reaction. Furthermore, the evaporated metal atoms and the like that have been ionized in the plasma are accelerated by a cathode dark space that is generated around the workpiece and collide with the surface of the workpiece with high energy. This causes the surface of the workpiece to heat up at the molecular level, thus forming a metal vapor-deposited film that is highly adhesive.

Incidentally, the second wire 12 and the third wire 13 formed by the metal vapor-deposited film are insulated from each other, and therefore the cylindrical metal vapor-deposited film needs to be split into the second wire 12 and the third wire 13 after the task of forming the metal vapor-deposited film as described above.

Figure 6A:
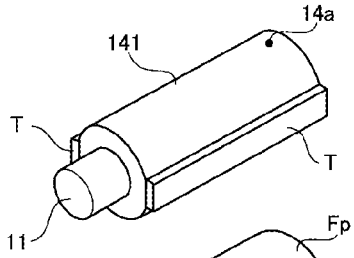
FIGS. 6A-6D are diagrams showing steps for integrating the first to third wires in the wire harness according to an embodiment of the invention in the form of one wire.
Figure 6B:
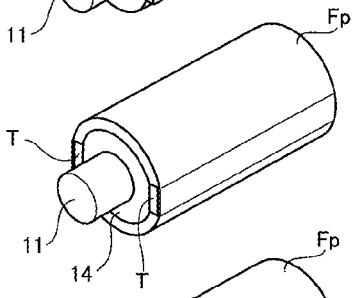
Figure 6C:
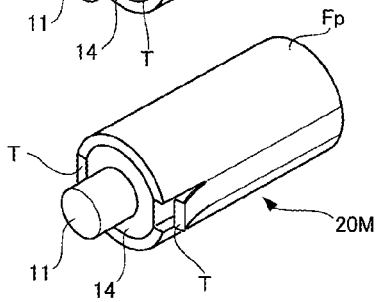

In view of this, as shown in FIG. 6A for example, before the task of forming the metal vapor-deposited film, a pair of pieces of masking tape T (illustrated in the drawing with the width and thickness of the masking tape exaggerated) are adhered in parallel to the outer circumferential surface 14*a* of the wire sheathing 14. Also, as shown in FIG. 6B, a metal vapor-deposited film Fp is formed on the outer circumferential surface 14*a* of the wire sheathing 14 and the masking tape T, and thereafter, as shown in FIG. 6C, the cylindrical metal vapor deposition film Fp is split into the second wire 12 and the third wire 13 by peeling off the masking tape T from the outer circumferential surface 14*a* of the wire sheathing 14.

Figure 6D:
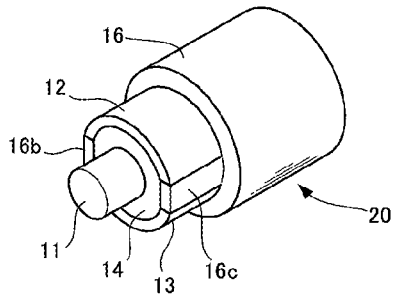

Then, when the outer insulating sheathing 16 that surrounds and sheathes the perimeter of the compound wire material 20M that has been split into the second wire 12 and the third wire 13 is formed using a known extrusion molding device, as shown in FIG. 6D, the compound wire 20 is formed in which the first wire 11, the second wire 12, and the third wire 13 are insulated from each other by the wire sheathing 14 and the outer insulating sheathing 16.

The second wire 12 and the third wire 13, which are formed in this manner so as to be fixed to the outer circumferential surface 14*a* of the wire sheathing 14, are dense, roughly-cylindrical vapor-deposited conductive films that are difficult to separate from the outer circumferential surface 14*a* of the wire sheathing 14.

That is to say, a layer of a metal-containing plasma polymer film, which is a strong adhesion layer on which the second wire 12 and third wire 13 and the outer circumferential surface 14*a* of the wire sheathing 14 penetrate each other so as to bond on the molecular level, is formed on the adhesion surface portion between the second wire 12 and third wire 13, which are conductive films, and the outer circumferential surface 14*a* of the wire sheathing 14. In this context, the layer of the metal-containing plasma polymer film, or in other words, the metal-containing plasma polymer layer, can be formed preferably using high-frequency ion plating, or may be formed using a method such as sputtering or the like, as long as sufficient adhesion strength (peeling resistance) with respect to thermal contraction can be achieved.

The film thickness of the second wire 12 and the third wire 13 is set to a suitable film thickness value between a minimum film thickness value of 1 μm or less and a film thickness value of around several tens of μm, for example.

Figure 3:
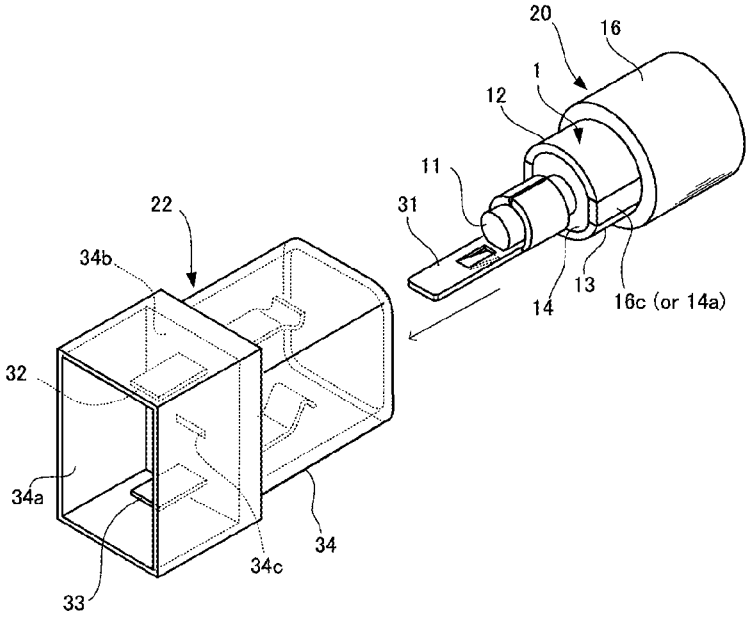
FIG. 3 is a perspective view of both the connector shown in FIG. 2 and the first to third wires, and shows a state before the connector is mounted to the first to third wires.
Figure 4:
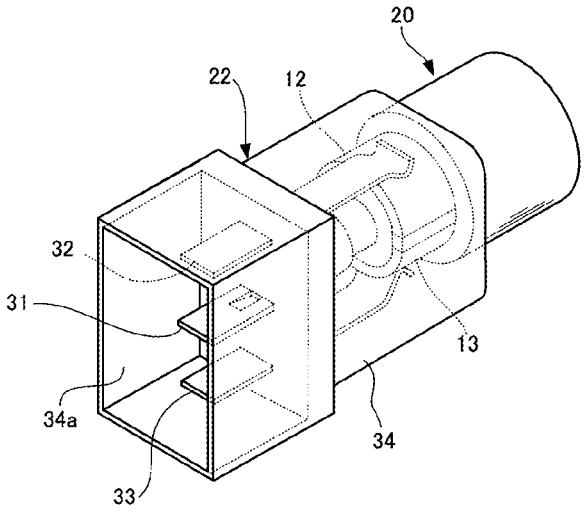
FIG. 4 is a perspective view showing a state after the connector shown in FIG. 2 is mounted to the first to third wires.
Figure 5:
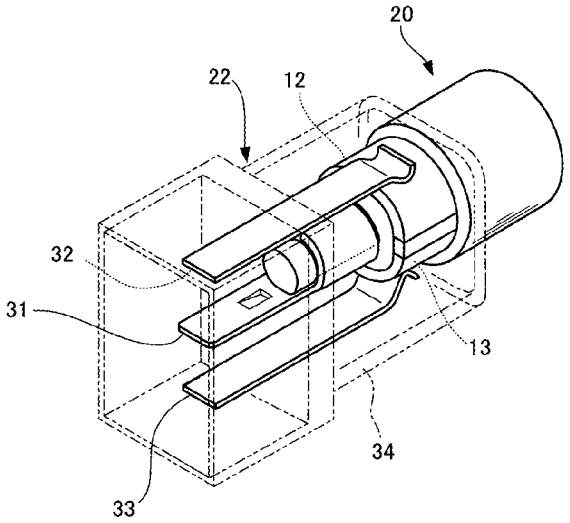
FIG. 5 is a diagram illustrating a state in which first to third conductors in the connector and the first to third wires shown in FIG. 4 are connected to first to third terminals.

Note that in FIGS. 2 and 3, the first terminal 31 is illustrated as being configured as a plate-shaped terminal that is crimped to one end of the first wire 11 and is arranged such that the leading end thereof is offset from the center of the first wire 11. However, for example, it is also possible to crimp one tube-shaped end to one end of the first wire 11 and arrange the first terminal 31 on the center line of the first wire 11 by forming the other end into a closed circular columnar terminal shape or by flattening the other end into a plate shape.

Next, an effect will be described.

With the wire harness W configured as described above according to the present embodiment, the second wire 12 and the third wire 13 can be fixed and integrated while insulated from each other, along the outer circumferential surface 14*a* of the wire sheathing 14 surrounding the first wire 11. Therefore, it is possible to form the compound wire 20, in which the first to third wires 11 to 13, which can be used as conductors for three channels, are arranged with a smaller radial dimension. Accordingly, the wire harness W that includes the multiple wires 11 to 13 can be made narrower.

Furthermore, since the second wire 12 and the third wire 13 are opposing split tube-shaped conductors, a configuration is possible in which an approximately tube-shaped conductor layer is formed around the first wire 11 using the second wire 12 and the third wire 13 so as to achieve an electromagnetic shielding effect of some extent, without adding a shield member. As a result, a wire harness W with a shield structure that can achieve the required shielding effect while sufficiently meeting the requirements of weight reduction and cost reduction is obtained.

Also, in the present embodiment, the wire sheathing 14 is formed by lamination on the outer circumferential surface 11*a* of the first wire 11, and the second wire 12 and the third wire 13 are formed so as to be fixed to the outer circumferential surface 14*a* of the wire sheathing 14, whereby the first wire 11, the second wire 12, and the third wire 13 are integrated in the form of one compound wire 20 while being insulated from each other.

Accordingly, it is easier to handle the first to third wires 11 to 13, and workability in the step of manufacturing the wire harness W improves.

Furthermore, in the present embodiment, the wire W further includes the connector 22. The connector 22 includes the first terminal 31, which connects the first wire 11 to, among the three terminals of the transistor 51, the terminal 51*a* that corresponds to output, and the second terminal 32 and third terminal 33, which connect the second wire 12 and the third wire 13 to, among the three terminals of the transistor 51, the positive terminal voltage (B+) side and the negative terminal voltage (B−) side of a power supply.

Accordingly, the required shielding effect can be achieved while meeting the requirements of weight reduction and cost reduction in the wire harness W including the wires 11 to 13, which are used in the transistor input/output circuit 50.

In addition, in the present embodiment, the outer insulating sheathing 16, which is a retaining member, surrounds the second wire 12 and the third wire 13 and insulates them from each other, and thereby the first wire 11, the second wire 12, the third wire 13, the wire sheathing 14, and the outer insulating sheathing 16 are integrated in the form of one compound wire 20. Accordingly, the compound wire 20, which can be handled as substantially one wire, is provided with conductors for three circuits, whereby the number of wires can be reduced, which is further advantageous for weight reduction and cost reduction.

Figure 7:
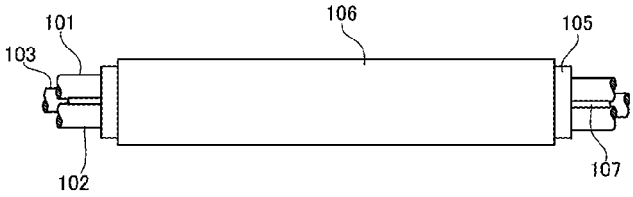
FIG. 7 is a side view showing relevant portions of a wire harness according to a comparative example.

A comparative example is shown in FIG. 7 to clarify such effects of the present invention.

Similarly to the first to third wires 11 to 13 in one embodiment, multiple wires 101, 102 and 103 shown in FIG. 7 are used in the transistor input/output circuit 50 via a three-terminal connector. Any of the wires 101 to 103, which are signal wires, are formed into a twisted pair wire as a countermeasure against noise, and thereafter, covering is performed by overlaying a shielding material 105 and an outer material 106 for sheathing, and a drain wire 107 is furthermore provided.

In this comparative example, the wires 101 to 103 are all insulation-sheathed wires, and since a double-core or triple-core twist wire including a signal wire is formed and covered by overlaying the shielding material 105 and the outer material 106 for sheathing from the outside thereof, not only are many parts used, but it is also unavoidable that the radial dimension of the wire harness at the shielded segment will increase.

In contrast to this, in the wire harness W of the embodiment, it is understood that the multiple wires 101 to 103 of the comparative examples can be replaced with the compound wire 20, and thus the number of wires is reduced, the radial dimension of the wire harness at all segments, including the shielded segment, is reduced, and manual labor during the step of manufacturing or handling the wire harness W is reduced significantly, whereby further advantages in weight reduction and cost reduction are obtained.

Note that in the above-described embodiment, a thin-film conductor composed of a vapor-deposited film was used for the second wire 12 and the third wire 13 for shielding. However, the second wire and the third wire in the context of the present invention may be formed as independent linear members that are curved in cross section instead of as metal thin films, and may be embedded in a sheathing resin. Also, it is conceivable that when the conductive film that is to be the second wire and the third wire is to be formed, the wires are formed into a pair of independent split tube shapes from the beginning. Also, it is naturally the case that the second wire and the third wire may be formed at the same time and split thereafter using a masking method other than masking tape.

Furthermore, in the above-described embodiment, the second wire 12 and the third wire 13 were formed using high-frequency ion plating, which provides high adhesiveness. However, it is possible to use a vapor-deposited film formed using a method such as sputtering or the like.

As described above, the present invention can provide a wire harness that has a shielding structure that can exhibit a required shielding effect while sufficiently meeting the requirements of weight reduction and cost reduction. The present invention is useful for all wire harnesses having an electromagnetic shielding structure that is suitable in the case of being used in a transistor input/output circuit, or the like.

What is claimed is:

1. A wire harness including a wire group having a plurality of wires and a retaining member that surrounds the wire group such that the wire group is retained in the form of a bundle, the wire group comprising:

a first wire composed of a linear conductor that is located toward the center of the wire group, a tube-shaped wire sheathing that surrounds the first wire, and second and third wires composed of an opposing pair of split tube-shaped conductors that are insulated from each other with the first wire and the wire sheathing interposed therebetween.

2. The wire harness according to claim 1, wherein the wire sheathing is in close contact with the outer circumferential surface of the first wire, the second wire and the third wire are fixed to the outer circumferential surface of the wire sheathing, and the first wire, the second wire, and the third wire are insulated from each other and integrated in the form of one wire.

3. The wire harness according to claim 2, further comprising:

a connector having a first terminal that connects the first wire to one terminal of a transistor corresponding to output, and second and third terminals that respectively connect the second wire and the third wire to a positive terminal voltage side and a negative terminal voltage side of a power supply with respect to the transistor.

4. The wire harness according to claim 2, wherein the retaining member comprises an outer insulating sheathing that surrounds the second wire and the third wire and insulates them from each other, and the first wire, the second wire, the third wire, the wire sheathing, and the outer insulating sheathing are integrated in the form of one wire.

5. The wire harness according to claim 3, wherein the retaining member comprises an outer insulating sheathing that surrounds the second wire and the third wire and insulates them from each other, and the first wire, the second wire, the third wire, the wire sheathing, and the outer insulating sheathing are integrated in the form of one wire.

* * * * *